US006331749B1

(12) United States Patent
Makienko et al.

(10) Patent No.: US 6,331,749 B1
(45) Date of Patent: Dec. 18, 2001

(54) EXCITATION METHOD OF LASER CATHODE-RAY TUBE

(75) Inventors: Oleg Mikhailovich Makienko, Fryazino; Nikolai Grigoryevich Rumyantsev, deceased, late of Shelkovo; Yury Vladimirivich Petrushenko, Fryazino, all of (RU), legal representative

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/243,172

(22) Filed: Feb. 2, 1999

(30) Foreign Application Priority Data

Feb. 4, 1998 (RU) ..... 98102522

(51) Int. Cl.[7] ..... H01J 31/00
(52) U.S. Cl. ..... 313/2.1; 313/413
(58) Field of Search ..... 313/1, 2.1, 409, 313/441, 463, 474, 413; 372/74

(56) References Cited

U.S. PATENT DOCUMENTS

| | | | | |
|---|---|---|---|---|
| 3,558,956 | | 1/1971 | Basov et al. | 313/92 |
| 3,575,627 | * | 4/1971 | Nicoll | 313/92 |
| 4,777,407 | * | 10/1988 | Takenaka et al. | 313/413 |
| 5,280,360 | | 1/1994 | Derdyra et al. | 358/242 |
| 5,374,870 | * | 12/1994 | Akhekyan et al. | 313/463 |
| 5,687,185 | * | 11/1997 | Kozlovsky et al. | 313/463 |

* cited by examiner

*Primary Examiner*—Nimeshkumar D. Patel
*Assistant Examiner*—Todd Reed Hopper
(74) *Attorney, Agent, or Firm*—Christie, Parker & Hale, LLP

(57) ABSTRACT

The laser cathode ray tube has a laser screen; a focusing system for focusing the electron beam on the laser screen; a deflection system for deflecting the electron beam; and at least two electron guns with cathodes for generating at least two electron beams focused simultaneously on one and the same laser screen element defined by the deflection system.

20 Claims, 1 Drawing Sheet

EXCITATION METHOD OF LASER CATHODE-RAY TUBE

BACKGROUND OF THE INVENTION (a) Field of the Invention

The invention relates to laser cathode-ray tubes (CRT) having an electron gun with a cathode for generating an electron beam, a laser screen, a focusing system for focusing the electron beam on the laser screen and a deflection system for deflecting this beam, and laser cathode ray tubes used, e.g., in projection television systems for displaying images on large square screens or in any field of technology where CRT's are used.

(b) Description of the Related Art

Projection television systems based on conventional cathode-ray tubes having a fluorescent screen are widely used for displaying images on the screens having an area of up to several square meters. However, limited and divergent light beam inherent to such systems makes it difficult to form images of large size with required brightness and contrast. This disadvantage is largely caused by the effect of saturation of the fluorescent intensity resulting from the increase in the current density of the electron beam, as well as by dispersion of the light radiation in the luminophor of a conventional cathode-ray tube.

An effective way to improve the parameters of projection television systems is connected with using laser CRT's (see, for example, U.S. Pat. No. 3,558,956), in which the above-mentioned saturation effect and losses in the luminophor are removed.

As distinct from the conventional CRT's, the source of the radiation in the laser CRT is a laser target that is a thin semiconductor monocrystalline plate having either of its parallel surfaces covered by coatings. A fully reflecting mirror metal coating is usually applied to the surface on which the electron beam is incident, while the other side of the plate is covered with a semitransparent mirror coating. The mirror surfaces constitute an optical resonator, while the semiconductor plate between them acts as an active medium of the laser leading to electron-beam excitation (pumping). The laser target is usually fixed to a transparent substrate serving as the optical output window of the laser CRT and also as a heat sink for the laser target. The substrate can be made of, e.g., sapphire having a high thermal conductivity. The laser target constitutes the screen of the laser CRT (laser screen) together with the transparent substrate.

The electron beam penetrates into the semiconductor plate through the metal coating and induces spontaneous light radiation. When the surface density of the current produced by the beam on the laser target equals a threshold value, the power of the induced light radiation will compensate the losses in the optical resonator and the element of the target on which the electron beam is incident will generate laser radiation. When light passes repeatedly through the resonator, its spectrum narrows, with the result that the emitted light is monochromatic. The laser light is radiated through the semitransparent mirror coating perpendicularly to the surface of the semiconductor plate and leaves the CRT through the sapphire output window.

In U.S. Pat. No. 5,280,360 a laser CRT is described, the CRT including an electron gun with a cathode for generating an electron beam, a laser screen, a focusing system for focusing the electron beam on the laser screen and a deflection system for deflecting this beam.

The method of exciting the screen of the laser CRT according to the above-mentioned patent comprises generating an electron beam and directing this beam to an element of the laser screen for exciting laser radiation. The laser radiation is excited when the current density produced by the electron beam on the element of the screen exceeds a threshold value.

In case of conventional CRT's the increase of the density of electron beam current on each element is useless due to the saturation of fluorescent intensity resulting from the power increase of electron beam. Further, it is known that increase in the current of an electron beam results in its greater diameter because of interaction among the electrons forming the electron beam. Because of this, the increased beam current in the known laser CRT's does not provide a proportional increase in the current density on the laser screen. Therefore, the light radiation intensity does not increase in proportion with the increase of the current. Other negative consequence of the increase in the diameter of the electron beam is reduction in the resolution of the laser CRT.

SUMMARY OF THE INVENTION

The principal object of the invention is to provide a laser CRT and a method of its excitation, wherein the laser screen is pumped by an electron beam in such a manner that an increase in the current of the electron beam incident on the laser screen is not accompanied by an increase in the beam diameter, whereby larger light radiation intensity and higher resolution, as compared with conventional CRT's, are provided.

With the principle object in view, there is proposed a laser CRT having an electron gun with a cathode for generating an electron beam, a laser screen, a focusing system for focusing the electron beam on the laser screen and a deflection system for deflecting this beam, wherein, according to the invention, the laser CRT comprises at least two electron guns with cathode for generating at least two electron beams focused simultaneously on one and the same laser screen element defined by the deflection system.

The laser CRT preferably comprises at least two separate focusing systems for focusing respective beams.

The laser CRT preferably comprises a common deflection system for deflecting all the beams simultaneously.

The laser CRT preferably comprises at least two separate electrodes for respectively controlling the currents of the electron beams generated by respective electron guns. With the above principle object in view, there is also proposed a method for exciting the laser CRT, wherein an electron beam is generated and directed on an element of the screen for exciting the laser radiation, in which method, according to the invention, at least two separate electron beams are generated and focused simultaneously on the same element of the screen.

Each separate electron beam may be generated and focused with respective separate cathode and respective separate focusing system.

For exciting laser radiation, the summary current density of the electron beams directed simultaneously on the same element of the screen shall exceed a threshold value required for exciting laser radiation.

Using several electron beams exciting simultaneously the same element of a laser screen allows the summary excitation current to be increased without increase in the diameter of the beam. It makes possible providing a larger current density (i.e. surface current density) and, therefore, a greater intensity of the light radiation, as compared with the conventional laser CRT, together with a high resolution. On the other hand, with the same radiation power, the proposed laser CRT provides a higher resolution than a known CRT because of the smaller diameter of the beam.

BRIEF DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention.

DETAILED DESCRIPTION OF THE PREFERRED EMBODIMENTS

Figure 1:
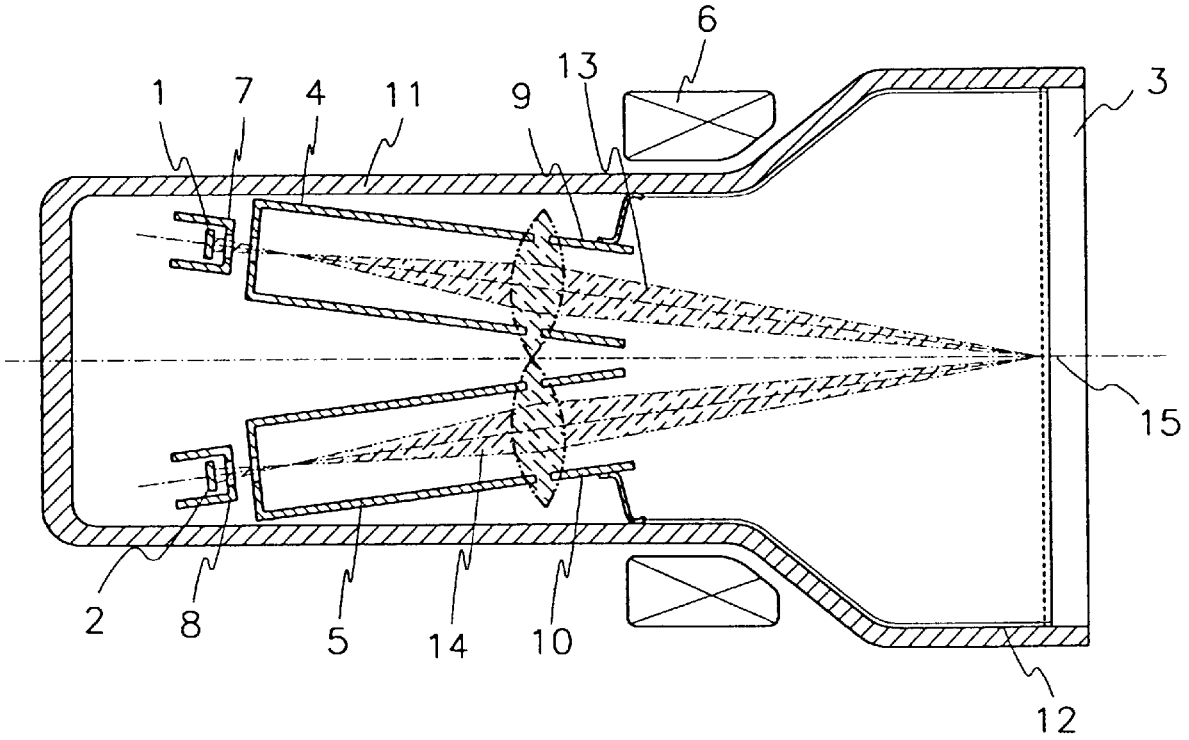
FIG. 1 is a sectional view of the laser CRT according to an embodiment of the present invention.

The following is the detailed description of a preferred embodiment with reference to the drawing.

A laser CRT shown in FIG. 1 contains two electron guns with cathodes 1 and 2 having electron-emitting oxide surfaces heated by filaments. A laser screen 3 of the laser CRT includes a semiconductor laser target attached to a transparent substrate of sapphire. Also the laser CRT has two focusing systems constituted by focusing electrodes 4 and 5, and a common electromagnetic deflection system 6, including coils for vertical and horizontal deflection of the electron beams.

In another embodiments of the laser CRT one common focusing system may be used. Also separate deflection systems may be used for separate beams.

The electron guns of the laser CRT also include modulator electrodes 7 and 8 made as hollow cylinders with orifices located opposite to the centers of the respective cathodes. In another embodiments of the laser CRT one common modulator electrode may be used for all the beams.

The laser CRT also includes high-voltage electrodes 9 and 10. The elements of the laser CRT are placed in a common glass bulb 11. The laser screen is installed in the end face of the bulb 11. The portion of the inside surface of the bulb 11 adjoining the laser screen 3 is covered by a conductive coating 12 electrically connected with the high-voltage electrodes 9 and 10. The deflective system 6 is installed on the outside of the bulb 11.

The laser CRT operates as follows. The cathodes 1 and 2 are heated by an external current source (not shown) that brings about emission of electrons. Also, from an external source (not shown) a high accelerating voltage positive with respect to the cathodes is applied to the high-voltage electrodes 9 and 10. The cathodes I and 2 may be electrically connected together. Electron beams 13 and 14 generated by the cathodes 1 and 2, respectively, under the action of the high accelerating voltage applied both to the electrodes 9, 10 and to the conductive coating 12 on the inside surface of the bulb 11, move toward the laser screen 3. A video signal voltage having negative polarity with respect to the respective cathode is applied to the modulators 7 and 8 from an external source of the video signal (not shown). The voltage of the video signal applied to a modulator controls the amount of the electrons directed to the laser screen 10, i.e. the current of the electron beams 13 and 14. The modulators 7 and 8, as well as cathodes 1 and 2, may be electrically connected together and be supplied with the video signal from the single output of the video signal source. Alternatively, the modulators 7 and 8, may be connected to separate outputs of the video signal source to make it possible to adjust separately the currents of the electron beams 11 and 12, for example, for precisely equalizing these currents.

The potentials providing electrostatic focusing of the electron beams 13 and 14 on the laser screen 3 are applied to the focusing electrodes 4 and 5. In electrostatic focusing, the electrical fields formed by the focusing electrodes 4, 9 and the accelerating electrodes 5, 10 constitute electron lenses (shown by the dashed lines) which condense the divergent electron beams generated by the cathode 1 and 2 into narrow converging beams. The longitudinal axes of the electron guns constituted by the elements 1, 4, 9, and 2, 5, 10, respectively, are installed at such an angle to each other that the electron beams 13 and 14 are incident on the same point 15. When there is no current flow in the coils of the deflection system 6, said point 15 is located in the center of the screen 3. To correct the inaccurate spatial adjustment of the electron guns, means for adjusting the beam convergence can be included in the system, which means may be similar to those used in the conventional color three-beam CRT. These means can, for example, be made as magnets (not shown) placed on the outside of the bulb 11, or fulfilled by other known means for precise beam convergence.

The coils of the deflection system 6 are supplied with horizontal and vertical scanning signals of a saw-toothed form. The electromagnetic fields of the coils deflect simultaneously both the electron beams 13 and 14 in horizontal and vertical directions, which provides forming a television raster, much as it is formed in known cathode-ray tubes. When simultaneously deflected, the beams 13 and 14 are incident on the same point 15 of the laser screen 3 within the television raster. Known systems used in the conventional color three-beam CRT for dynamic convergence can be used for the control of possible divergence of beams 13 and 14 during the scanning.

The DC component of the video signal voltage applied to the modulators 7 and 8 is adjusted in such a manner that, when the video signal corresponds to the black level, the summary current density of the electron beams 13 and 14 does not exceed the threshold value and laser radiation is not generated. When the video signal voltage is between the black level and white level, the electron beams 13 and 14 produce on the surface of the screen 10 a summary current density exceeding the threshold value, with the result that the element 15 of the screen 10 on which the electron beams 13 and 14 are incident generates laser radiation. The intensity of the radiation from the screen element 15 is proportional to the summary current density which, in turn, is dependent on the video signal voltage applied to the modulators 7 and 8 at a given moment. The synchronized supply of the laser CRT with scanning and video signals provides forming a television image projected from the laser CRT to an external screen (not shown).

Using two electron beams 13 and 14 exciting simultaneously the same element 15 of the laser screen 3 makes it possible to double the surface density of the excitation current without increase in the current and diameter of the beams 13 and 14. If the current of the beam in a known single-beam laser CRT is doubled, the diameter of the beam will also increase because of the interaction among the electrons constituting the beam, with the result that the current density will not be doubled. The increased diameter of the electron beam resulting from increased current, found in said laser CRT, causes inferior resolution. Therefore, compared with known single-beam CRT's, a greater intensity of the light radiation and a higher resolution can be obtained in the inventive laser CRT which allows a smaller diameter of the electron beam and greater current density, Threshold value of the surface current density increases rapidly with the rising temperature of the laser target. The present invention, which increases the current density produced on the screen 3 by the electron beams 13 and 14 without increasing the diameter of the double beam incident on the screen 3, enables a laser CRT to operate under a higher temperature of the laser target. Therefore, the current of the electron beams 13 and 14 may be further increased, or the demands imposed on the cooling system may be made less stringent.

The described design of the laser CRT with two electron guns is presented only as an example. The required number of the guns, and thus, the electron beams is determined by the required intensity of the light radiation of the art and can be more than two, e.g. three or more. The invention relates not only to the above-depicted embodiments of the laser CRT where video signal voltage is applied to modulator electrodes, but to general laser CRT where video signal voltage is applied through cathodes.

The above excitation method of the laser CRT, compared with conventional laser CRT, can achieve with no increase in diameter of the beams greater intensity of laser radiation and superior resolution.

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents. This application is based on application No. 98102522/09 Russian Patent Office on Feb. 4, 1998, the content of which is incorporated herein by reference.

What is claimed is:

1. A laser cathode ray tube comprising:

a laser screen;

a focusing system for focusing at least two electron beams simultaneously on one point on the laser screen;

a deflection system for deflecting the at least two electron beams; and at least two electron guns each with a cathode for generating the at least two electron beams.

2. The laser cathode ray tube according to claim 1, further comprising:

two separate modulator electrodes for controlling each current of the electron beams generated by respective electron guns.

3. The laser cathode ray tube according to claim 1, further comprising:

at least two separate focusing systems for focusing respective beams.

4. The laser cathode ray tube according to claim 3, further comprising:

two separate modulator electrodes for controlling each current of the electron beams generated by respective electron guns.

5. The laser cathode ray tube according to claim 1 or 3, further comprising:

a common deflection system for deflecting all the beams simultaneously.

6. The laser cathode ray tube according to claim 5, further comprising:

at least two separate modulator electrodes for respectively controlling the currents of the electron beams generated by respective electron guns.

7. A laser cathode ray tube comprising:

a glass bulb;

a deflection system installed outside the glass bulb;

a screen mounted on the end face of the glass bulb;

a plurality of electron guns installed inside the glass bulb, each of the guns having a cathode, for generating a plurality of electron beams focused simultaneously on one point of the screen under the control of the deflection system; and a focusing system for focusing the electron beams on the screen.

8. A method for exciting a laser cathode ray tube having a laser screen comprising the steps of:

generating at least two separate electron beams; and focusing the at least two separate electron beams simultaneously on the same point on the laser screen.

9. A method for exciting a laser cathode ray tube having a laser screen according to claim 8, wherein the at least two separate electron beams are generated with a respective separate cathode and focused by a respective separate focusing system.

10. A method for exciting a laser cathode ray tube having a laser screen according to claim 8 or 9, wherein a current density of the electron beams directed simultaneously on the same point of the screen exceeds a threshold value required for exciting laser radiation.

11. A laser cathode ray tube comprising:

a laser screen having a plurality of screen elements;

two electron guns each having a cathode for generating an electron beam;

a focusing system for simultaneously focusing the electron beams on the same screen element of the laser screen; and a deflection system for deflecting the electron beams.

12. The laser cathode ray tube according to claim 11, further comprising two separate modulator electrodes each for controlling current of a respective electron beam.

13. The laser cathode ray tube according to claim 11, further comprising two separate focusing systems each for focusing a respective electron beam.

14. The laser cathode ray tube according to claim 13, further comprising two separate modulator electrodes each for controlling current of a respective electron beam.

15. The laser cathode ray tube according to claim 11 or 13, wherein the deflection system comprises a common deflection system for deflecting the electron beams simultaneously.

16. The laser cathode ray tube according to claim 15, further comprising two separate modulator electrodes each for controlling current of a respective electron beam.

17. A laser cathode ray tube comprising:

a glass bulb;

a deflection system installed outside the glass bulb;

a screen having a plurality of screen elements mounted on an end face of the glass bulb;

a plurality of electron guns installed inside the glass bulb, each of the electron guns having a cathode for generating an electron beam; and a focusing system for simultaneously focusing the electron beams on the same screen element of the screen under control of the deflection system.

18. A method for exciting a laser cathode ray tube having a laser screen with a plurality of screen elements, comprising the steps of:

generating two separate electron beams; and focusing the two separate electron beams simultaneously on the same screen element of the laser screen.

19. The method for exciting a laser cathode ray tube according to claim 18, wherein each of the two separate electron beams is generated by a respective separate cathode and focused by a respective separate focusing system.

20. The method for exciting a laser cathode ray tube according to claim 18 or 19, wherein a current density of the electron beams focused simultaneously on the same screen element exceeds a threshold value required for exciting laser radiation.

* * * * *